US005531386A

United States Patent [19]

Jensen

[11] Patent Number: 5,531,386

[45] Date of Patent: Jul. 2, 1996

[54] PILL PULVERIZER: APPARATUS

[76] Inventor: Reginald S. Jensen, 6945 Leibinger La., Roseville, Calif. 95661

[21] Appl. No.: 222,114

[22] Filed: Apr. 1, 1994

[51] Int. Cl.[6] ..... B02C 1/14; B02C 19/08; B02C 25/00

[52] U.S. Cl. ..... 241/36; 241/199.11; 241/263; 241/270; 241/DIG. 27

[58] Field of Search ..... 100/216; 241/36, 241/37.5, 199.8, 199.11, 262, 263, 270, 283, DIG. 27

[56] References Cited

U.S. PATENT DOCUMENTS

| | | | |
|---|---|---|---|
| 90,994 | 6/1869 | Clarenton | 241/270 X |
| 334,292 | 1/1886 | Seger | 241/199.11 |
| 1,137,272 | 4/1915 | Moyle | 241/270 X |
| 1,715,724 | 6/1929 | Thompson | 241/270 X |
| 4,366,930 | 1/1983 | Trombetti, Jr. | 241/169 |
| 4,765,549 | 8/1988 | Sherman | 241/169 |
| 5,067,666 | 11/1991 | Sussman | 241/DIG. 27 |
| 5,167,374 | 12/1992 | Strohmeyer | 241/36 |
| 5,169,076 | 12/1992 | Dols | 241/169 |
| 5,176,329 | 1/1993 | DeCoster et al. | 241/169 |
| 5,178,337 | 1/1993 | Lupoli | 241/169 |
| 5,180,114 | 1/1993 | Chen | 241/169 |
| 5,199,655 | 4/1993 | Yang | 241/169 |
| 5,318,229 | 6/1994 | Brown | 241/36 X |
| 5,355,788 | 10/1994 | Phinney | 241/36 X |

*Primary Examiner*—Timothy V. Eley
*Attorney, Agent, or Firm*—Bernhard Kreten

[57] ABSTRACT

A device 10 for crushing medicaments originally formed in pill of tablet contour into a fine powder. An impact device 140 moves from a first energy stored position latched thereagainst spring pressure awaiting tripping of the latch or cam 190 by the pill which has been ensconced in a container embodied as an envelope 260. The envelope 260 is placed in a slot 84 and oriented to trigger a switch 234 which releases from a captive position the hammer 142. The hammer 142 advances linearly impacting against an anvil 89 upon which the envelope 260 and the enclosed pill awaits. The explosive force of the hammer 142 creates a powder substance because of the explosive nature of the hammer's 142 contact against the anvil 89. While the hammer 142 is being withdrawn under motor drive 212, the envelope 260 may be removed for access to the interior contents for subsequent dispensation.

23 Claims, 5 Drawing Sheets

PILL PULVERIZER: APPARATUS

FIELD OF THE INVENTION

This invention relates generally to a device for comminuting objects and, in particular, a medical pill pulverizer which is especially suited for pulverizing tablets into powdered form so that they may be easily swallowed when mixed with a liquid or food substance.

BACKGROUND OF THE INVENTION

Many medicaments and nutriments are provided in tablet form. This is not a result of the manufacturer being unable to provide a liquid or powder form of the tablet, but instead probably stems in part from the result of being unable to precisely control the dosage of the medication and the economics involved in packaging the medication in powder or liquid form. The fact that most medication is predominantly available in tablet form may not be important to an individual who is able to take the tablet form of the medication, but rather to the individual who has difficulty swallowing the tablet in whole form. This is especially true when dispensing medication in a geriatric environment. Therefore, someone, typically a nurse, is required to crush or pulverize the tablet if it cannot be consumed in whole form. The powder is then dissolved in a liquid or mixed with a food substance which can be more easily swallowed.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,366,930 | January 4, 1983 | Trombetti, Jr. |
| 4,765,549 | August 23, 1988 | Sherman |
| 5,067,666 | November 26, 1991 | Sussman |
| 5,169,076 | December 8, 1992 | Dols |
| 5,176,329 | January 5, 1993 | DeCoster, et al. |
| 5,178,337 | January 12, 1993 | Lupoli |
| 5,180,114 | January 19, 1993 | Chen |
| 5,199,655 | April 6, 1993 | Yang |

A number of innovations have arisen to crush or pulverize tablets or pills, especially medicaments or nutriments, but problems still persist. For example, Lupoli, U.S. Pat. No. 5,178,337, teaches the use of a plier-like crusher with pivotal handles including serrated jaws. This crusher has a tendency to break up the tablets or pills in a chunk-like fashion rather than crushing or pulverizing the pill completely into powdered form. Furthermore, these chunks tend to exit the crusher in a projectile-like fashion thereby not only endangering the operator, but also losing a portion of the prescribed dosage that was to be administered to the patient.

U.S. Pat. No. 4,765,549 to Sherman and U.S. Pat. No. 4,366,930 to Trombetti, Jr. teach the use of alternative versions of the hand-operated pill crusher that address the problems of a portion of the pill being projected from the crusher. Yet they still fail to substantially conserve the entire dosage, a portion of which ends up coating surfaces of the pestle and/or mortar. As a result, a portion of the dosage of the pill may be lost. In addition, it is likely that a portion of a prior dose may cross-contaminate entirely different medication being crushed for subsequent dispensation to other patients.

U.S. Pat. No. 5,067,666 to Sussman teaches the use of a pill crusher which uses electrical means to continuously drive mechanical means against a pill. This ongoing pressure actually causes the pill to rebind into a pancake-like fashion instead of being pulverized into powder form. The problem of the device becoming contaminated by a previous pill is still prevalent in this type of pill pulverizer. In addition, the device is large and bulky in size which prevents it from being properly stationed upon a typical cart used to facilitate dispensing medicine. Furthermore, the portability of the device is hampered by the long duration of charge time needed to charge a non-removeable battery.

The other prior art listed above, but not specifically discussed, further catalogs the prior art of which the applicant is aware. The present invention diverges even more starkly from the references listed, but not discussed.

SUMMARY OF THE INVENTION

The instant invention is distinguished over the know prior art in a multiplicity of ways. For one thing, this invention does not require the application of manual force in achieving the pulverization process. In addition, unlike automated devices, the instant invention does not provide an ongoing continuous battery powdered force in order to achieve pulverization. Instead, a motor is used to move the hammer from a first deployed position to a second cocked position against spring pressure. Releasing the hammer causes the energy stored in the spring to explosively be imparted on the pill.

The pill itself is ensconced in a container prior to its having been impacted by the hammer. In this way, the contents of the pill is maintained in a constricted environment so that the entire medication is available for dispensation to the patient. In addition, the container is strategically constructed to preclude the contamination of the hammer and anvil apparatus associated with the pill crusher so that there is no cross-contamination between subsequent utilization of the device.

With the construction according to the present invention, a battery pack lends itself for utilization with the device to achieve portability because the only time the battery is being drained is to recock the hammer. The instant invention benefits from the rapid dissipation of kinetic energy against the pill which has been ensconced within the container to comminute the pill into pulverulent material while avoiding the tendency of recompacting the powder as it would occur in a crushing device that provides something other then a sharp impact.

OBJECTS OF THE INVENTION

A primary object of the present invention is to provide a new and novel pill pulverizer device for use in pulverizing pills.

A further object of the present invention is to provide a device as characterized above which uses the mechanical advantage of a cam to compress a spring thereby storing energy in the spring as potential energy.

Another further object is to provide means to instantly release the stored energy of the spring so that it may be used to pulverize a pill.

Another further object of the present invention is to provide a device that is not required to continuously supply power under full load conditions, i.e. crushing the pill, but only when compressing the spring.

Another further object is to provide a device as characterized above which includes high impact means to pulverize the pill completely instead of transforming the pill from a solid form having thickness into a thin solid form.

Another further object is to provide a container that ensconces the solid form of the pill during the pulverization process and also holds the powdered form of the pill, resulting in a dosage to be administered which remains true to that which was prescribed.

Another further object is to provide the container to avoid cross contamination between different medicaments being sequentially pulverized.

Another further object is to provide the container so that an impact means used to pulverize the pill does not require that the impact means be cleaned between uses.

Another further object is to use the container to activate the impact means.

Viewed from a first vantage point, it is an object of the present invention to provide a device for crushing pharmaceutical preparations to convert the preparations from a coherent mass to a powdered state comprised of energy storage means having an activated state and a quiescent state, impact means operatively coupled to said energy storage means, and anvil means cooperating with said impact means, activation means to release said energy storage means from said activated state to said quiescent state, whereby activation of said energy storage means causes said impact means to impart a blow to said anvil means.

Viewed from a second vantage point, it is an object of the present invention to provide a method for reducing an object initially formed from powdered material and presently constrained by a shape forming medium into a coherent mass back into powder form, the steps comprised of encompassing the object in a sterile environment, placing the encompassed object on an anvil, impacting the encompassed object with a hammer.

Viewed from a third vantage point, it is an object of the present invention to provide a device to pulverize at least one pill, comprised of energy storage means, impact means operatively coupled to said energy storage means and moves from a first deployed position to a second retracted position, anvil means oriented to cooperate with said impact means, means interposed between said impact means and said anvil means to receive the pill, cocking means to retract said impact means from said deployed position to said retracted position, activation means for disengaging said cocking means from said impact means whereby said energy storage means accelerates said impact means from said retracted position to said deployed position imparting a blow to said anvil.

These and other objects will be made manifest when considering the following detailed specification when taken in conjunction with the appended drawing figures.

DESCRIPTION OF PREFERRED EMBODIMENTS

Figure 1:
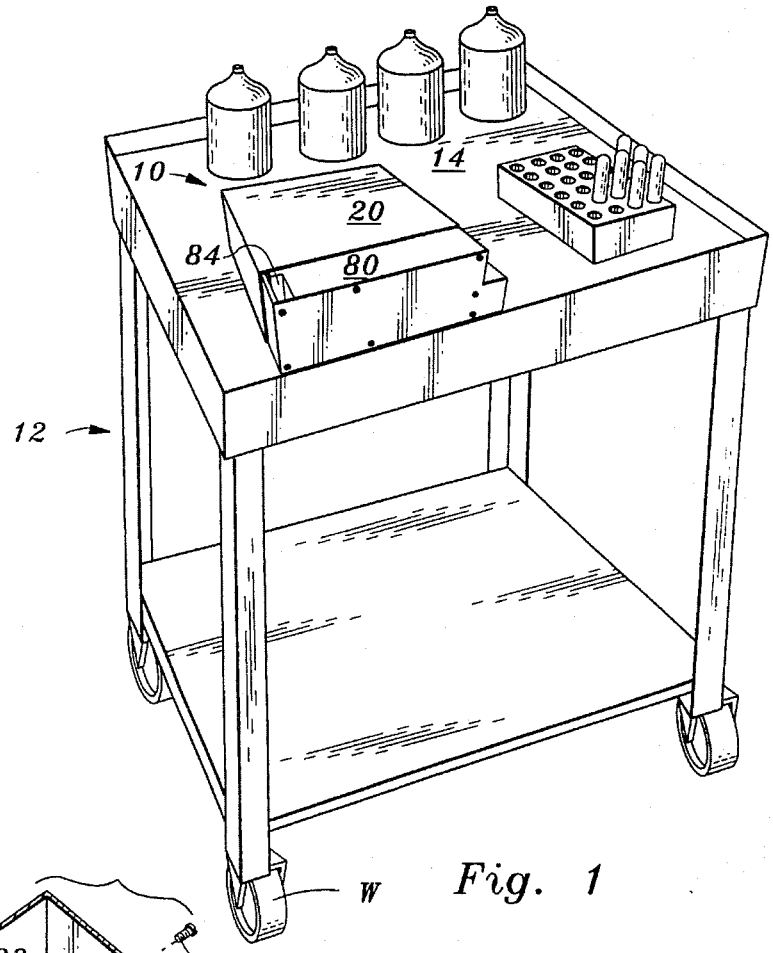
FIG. 1 is a perspective view of a pill pulverizer according to the present invention which is shown oriented upon a wheeled cart.

Considering the drawings, wherein like reference numerals denote like parts throughout the various drawing figures, reference numeral 10 is directed to the pill pulverizer device according to the present invention.

Figure 2:
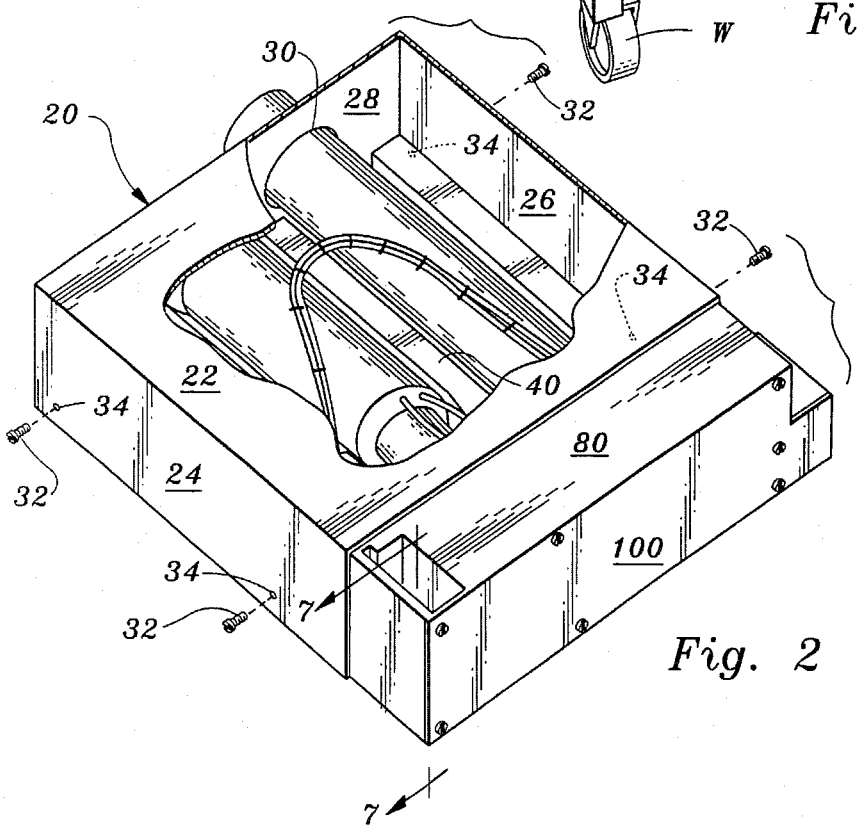
FIG. 2 is an elevational view from a front and side of the pill pulverizer with a top portion partially fragmented.

In essence and as shown in FIG. 1, for example, the pulverizer 10 is preferably disposed upon a cart 12 having wheels W on a bottom most extremity thereof and a top surface 14 which supports the pill pulverizer 10 along with various other medicaments to facilitate dispensing medicine. As shown in FIGS. 1 and 2, the pulverizer 10 is supported on a top surface 14 of the cart 12 by its base 40 (FIG. 2).

A case 20 overlies a major portion of the base 40. A front housing 80 extends from one extremity of the case 20. The front housing 80 is provided with means for allowing pills to be received within a slot 84 for subsequent pulverization.

Figure 3:
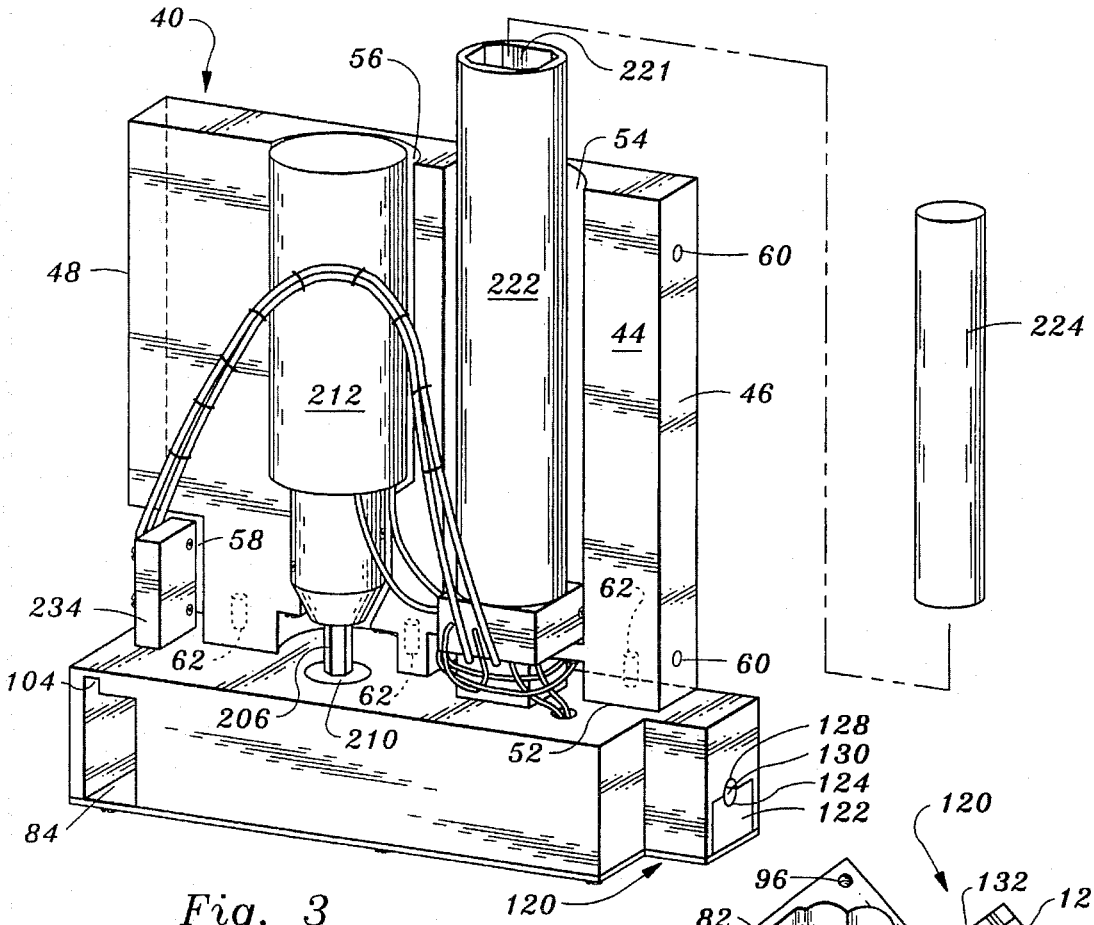
FIG. 3 is a perspective view of the pill pulverizer standing on its front and having the top cover removed.

More specifically, and referring to FIGS. 2 and 3, the pill pulverizer 10 may include the case 20 which is a substantially opened four-sided construct. Preferably, the case 20 comprises a top panel 22 integrally formed with generally parallel side panels 24, 26 and a back panel 28 including a back opening 30. The case 20 is detachably coupled to the base 40 by four side screws 32. Two of the side screws 32 run through openings 34 in each of the side panels 24, 26 of the case 20 and then couple to two threaded bores 60 provided in each longitudinal edge 46, 48 of the base 40.

The base 40 is preferably a substantially rectangular solid including a bottom 42 (FIGS. 3 and 4), a top 44, and generally parallel longitudinal edges 46, 48 and latitudinal edges 50, 52 therebetween. The top surface 44 is provided with two elongated semi-cylindrical recesses 54, 56. The first recess defines a saddle 54 which supports a battery pack 221 which includes a battery case 222 and battery 224. The second recess defines a seat 56 which supports a motor 212. An additional recess 58, preferably rectangular, is provided in one corner of the top surface 44 of the base 40. The rectangular recess 58 is located adjacent the slot 84 and supports an activation "fire" switch 234.

The bottom surface 42 (FIG. 4) of the base 40 is continuous from the back lateral edge 50 to the front lateral edge 52 whereas the top surface 44 of the base 40 includes the two elongated cylindrical recesses 54, 56 running from the back lateral edge 50 to the front lateral edge 52 thereby providing interrupted portions along the front and back lateral edges 50, 52 proximate to the top surface 44. In addition, the rectangular recess 58 also provides an interrupted portion along the front lateral edge 52 proximate to the top surface 44. These interrupted portions along the front lateral edge 52 form a series of legs adjacent the interrupted portions. Each leg is provided with a blind threaded bore 62 to be used to couple the front housing 80 tangent to the front lateral edge 52 by way of screws 81 passing through the housing 80 and threading into the blind threaded bores 62.

Figure 4:
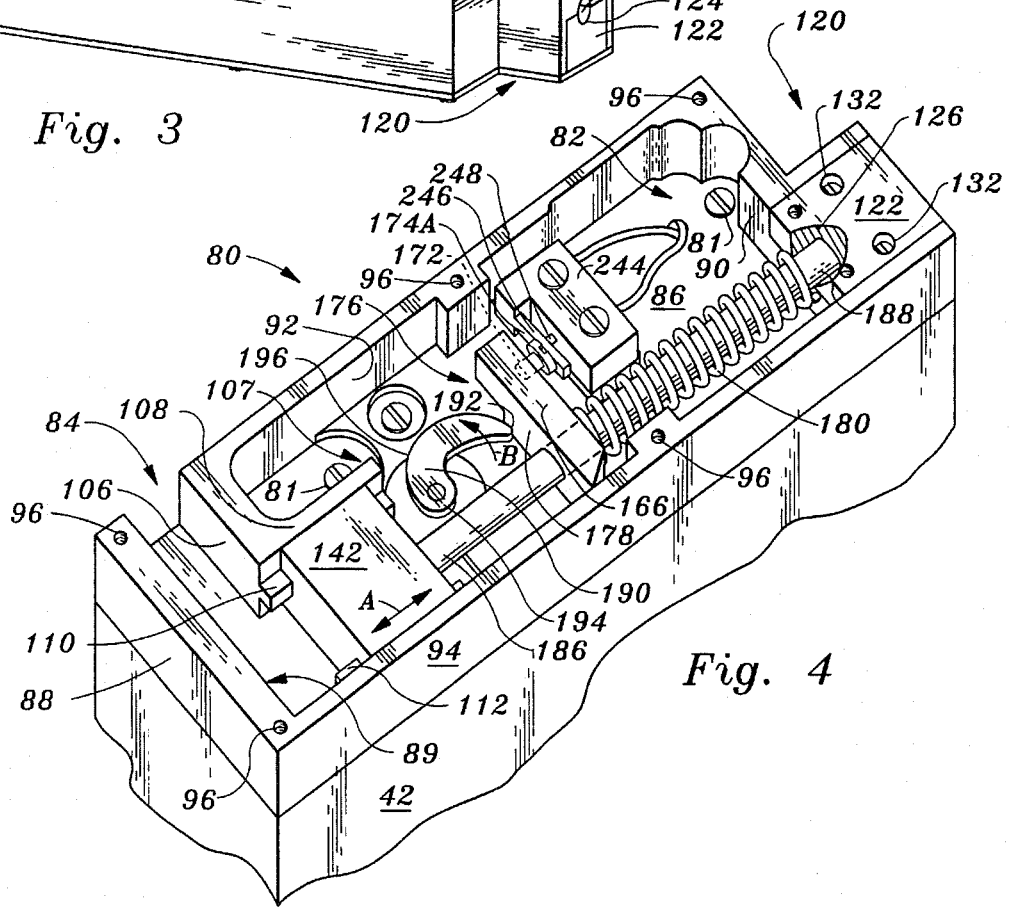
FIG. 4 is an elevational view of the front of the pill pulverizer with the front cover removed revealing a hammer in a retracted position.

Referring to FIG. 4, the front housing 80 is a five-sided rectangular solid including a well 82 and a slot 84. The five-sided rectangular solid includes a back wall 86 having a periphery from which two lateral walls 88, 90 and two longitudinal walls 92, 94 project therefrom, thereby defining the well 82 and slot 84. Threaded apertures 96 are spaced along a top surface of the four walls to accept a front cover 100 thereon (FIG. 2). This front cover 100 substantially closes the housing with the exception of the slot 84.

The slot 84 is provided in the top longitudinal wall 92 and is formed by two interior walls 106, 108 in the well 82 forming an "L" shaped partition by projecting into a major area of the well 82. Interior wall 106 is parallel to but spaced from lateral side wall 88. Interior wall 108 is parallel to and interposed between longitudinal wall 92, 94 and projects into the well 82. The slot 84 runs from the exterior surface of the top longitudinal wall 92 to the interior surface of the bottom longitudinal wall 94. The slot 84 is further provided with a shoulder 104 (FIG. 3) that is recessed into the back wall 86 and also runs from the exterior surface of the top longitudinal wall 92 to the interior surface of the bottom longitudinal wall 94.

As mentioned, the top wall 92 does not run continuously from the second lateral side wall 90 to the first lateral side wall 88, but instead is interrupted near the first lateral side wall 88 and communicating with two interior walls 106, 108 within the well 82. The bottom wall 106 is interposed between and perpendicular to the top longitudinal wall 92 and the guide wall 108. The bottom wall 106 is parallel to and spaced a distance from the first lateral side wall 88. The guide wall 108 extends away from the adjacent bottom wall 106 and toward the lateral wall 90 a short distance. The guide wall 108 is spaced a distance from the bottom longitudinal wall 94 and both walls 108, 94 include a section provided with guide rails 110, 112 in the same plane having a spaced parallel configuration. An anvil surface 89 is provided on an inner surface of lateral side wall 88. A hammer 142 contacts the anvil surface 89 and is constrained by the side rails 110,112 as it reciprocates along arrow "A".

A bore 130 passes through an extension 120 and supports a fixed end of the shaft 186. More specifically, the second lateral wall 90, opposite the slot 84 and the first lateral wall 88, includes the extension 120 extending perpendicularly outward. Referring to FIGS. 3 and 4, this perpendicular extension 120 includes a removable top section 122 having a grooved underside 124. When removed, a base section 126 and a groove 128 are exposed. When the top section 122 is placed on the base section 126 the grooves 124, 128 form the open-ended elongated circular bore 130 running from one end of the perpendicular extension 120 to the other. The top section 122 and the base section 126 of the perpendicular extension 120 are provided with at least one threaded aperture 132 on each side of the bore 130. The threaded apertures 132 in the top portion are aligned with the threaded apertures 132 in the base. Preferably, screws 134 that are countersunk secure the top section 122 to the base section 126.

The heart of the pulverizer is mounted within the well 82 of the housing 80. The back wall 86 of the well 82 threadedly couples of the electrical apparatus on the base 40 to power the pulverizer mechanism. The electrical apparatus which is supported by the base includes the motor 212 fastened to seat 56, the battery pack 221 fastened to the saddle 54 having a case 222 with a removable battery 224, an activation "fire" switch 234 fastened to the longitudinal edge 48 and an electromechanical relay RE1 fastened to the base 40 between the battery pack 221 and the front housing 80.

An output shaft 206 of the motor 212 is supported through the back wall 86 by way of a bearing 210. Once through the back wall 86 and into the well 82 of the housing 80 it is attached to a cam 190. The cam 190 includes a toe 192, a heel 194 and a face 196.

The impact means 140 includes a hammer head 142 coupled by way of slots 144, 146 to the guide rails 110, 112. A back face 150 of the hammer head 142 is operatively coupled to one end of a solid impact shaft 186. This shaft 186 runs from the back face 150 of the hammer head 142 through an aperture 178 in a cam-follower 166 and thence to the bore 130 where it is slideable coupled therein. The cam-follower 166 is rigidly coupled to the shaft 186 and a spring 180 circumscribes a portion of the shaft 186 between the slideable end 188 and the cam-follower 166.

FIG. 4 shows the cam-follower 166 as being substantially rectangular in shape and extending away from the solid shaft 186 toward the cam 190. A notch 176 is provided in a lower corner of the cam-follower 166 distal from the solid shaft 186. A second notch 107 is provided in the lower corner of the guide wall 108 adjacent the bearing 210 to provide clearance for the cam to rotate about arrow "B".

FIG. 4 shows the pill pulverizer as shown in a cocked or energy storage position. In this position the toe 192 of the cam 190 is located adjacent and proximate to the notch 176 provided in the lower corner of the cam-follower 166. The back flat face 170 of the cam-follower 166 is provided with a threaded blind bore 172 having a screw 174 received therein. The screw 174 has a head 174A with a top surface abutting against a lever 246 of a limit switch 244. The lever 246 in turn pushes on a trip 248 which causes the limit switch 244 to be in an open position when the impact means 140 is in the cocked position.

Figure 5:
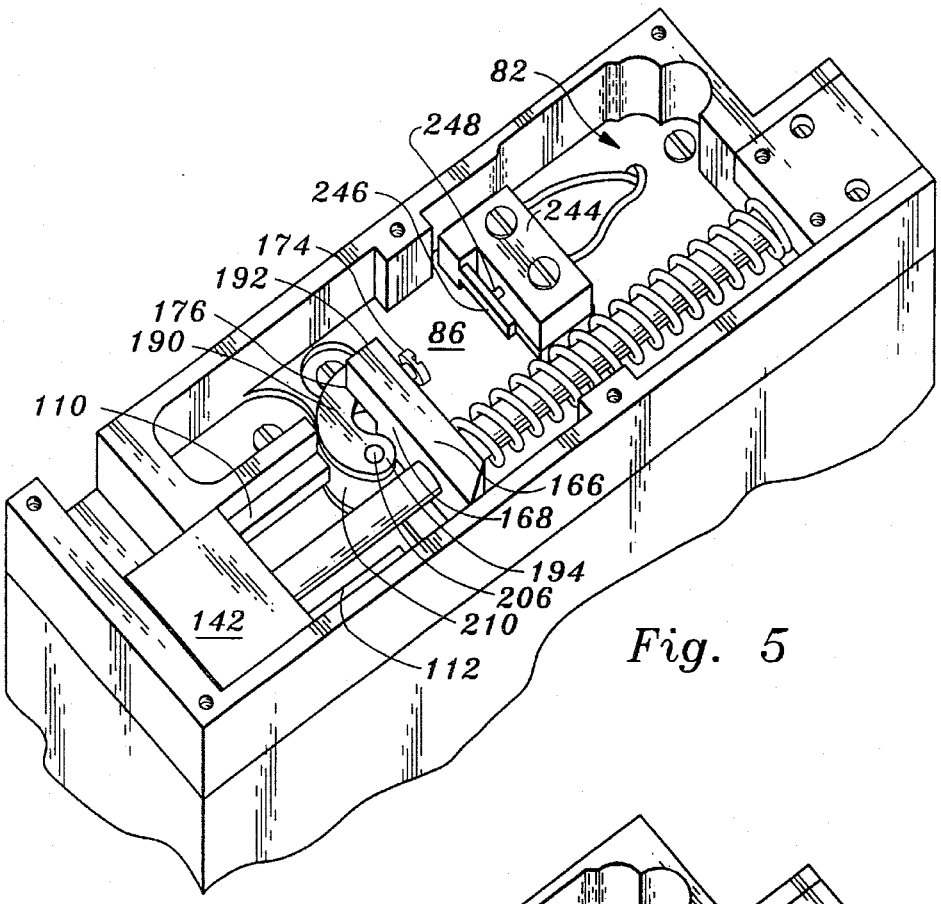
FIG. 5 is an elevational view of the front of the pill pulverizer with the front cover removed revealing a hammer in a deployed position.

Referring to FIG. 5, the "fire" switch 234 (FIG. 3) has just been activated thereby moving the toe 192 of the cam 190 from the cam-follower 166 and allowing the notch 176 of the cam-follower 166 to pass over the toe 192 of the cam 190. The screw 174 located in the back flat face 170 of the cam-follower 166 has now been relieved from the lever 246 of the limit switch 244 allowing the trip 248 to be decompressed thereby closing the limit switch 244. Once the cam 190 is relieved from the cam-follower 166 the hammer head 142 is accelerated by the spring 180 along the guide rails 110, 112. The hammer head 142 smashes against the anvil 89 thereby putting a stop to the acceleration of the impact means 140. This happens just prior to the front flat face 168 of the cam-follower 166 abutting against the heel 194 of the cam 190.

Figure 6:
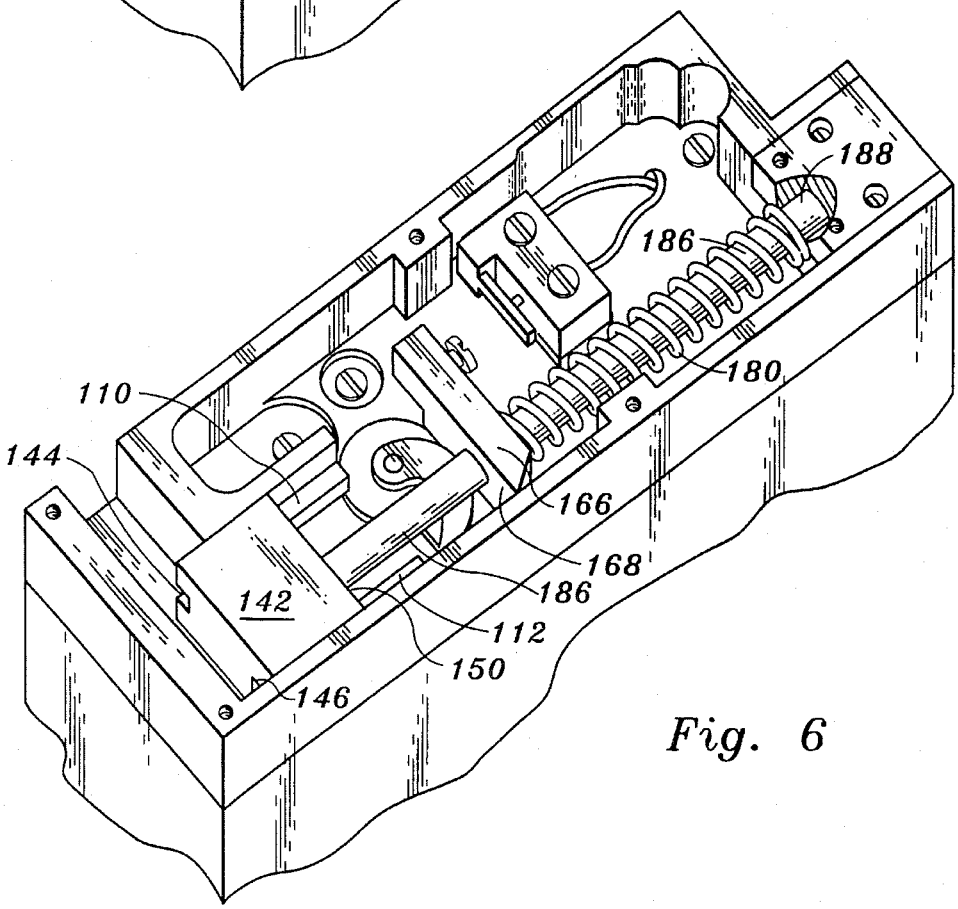
FIG. 6 is an elevational view of the front of the pill pulverizer with the front cover removed revealing a hammer being retracted from a deployed position to a retracted position.

Referring to FIG. 6, as the cam 190 continues to rotate under force from the motor 212. The cam 190 recocks the hammer head 142 by moving the cam-follower 166, thereby retracting the impact means 140 from a first deployed position or quiescent state (FIG. 5) to a second retracted position or activated state (FIG. 4).

Figure 8:
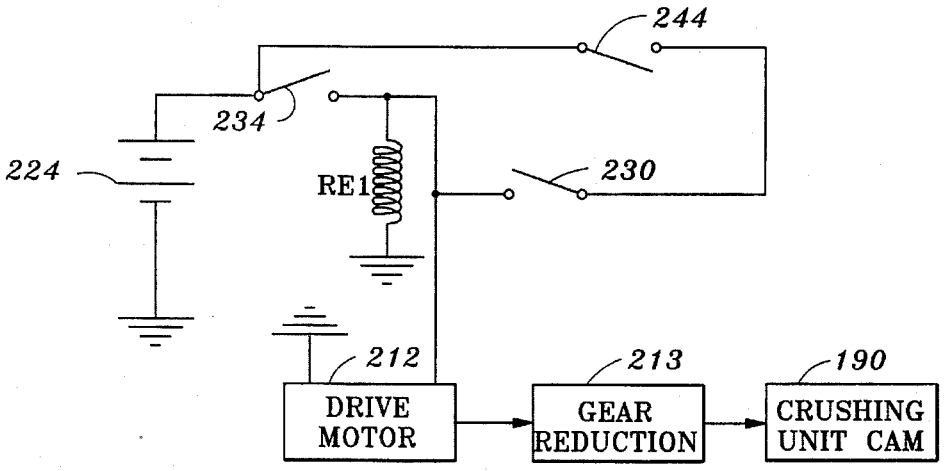
FIG. 8 is a schematic view of a circuit utilized for providing power to the drive motor.

Referring to FIG. 8, a schematic view of how the battery 224 is coupled to the drive motor 212 is shown. A relay RE1 is in parallel with the drive motor 212. A latching switch 230 (the switch controlled by relay RE1) is in series with a limit switch 244 and a battery 224. The activation "fire" switch 234 is in a direct energy path with the drive motor 212. When activated, the activation "fire" switch 234 provides an electrical connection between the battery 224 and the drive motor 212. When the activation "fire" switch 234 has been deactivated, the relay becomes de-energized and after a short time allows the latching switch 230 to open. The only time that the limit switch 244 remains opened is when the screw that has been received into the back flat face of the cam-follower 166 abuts against the lever of the limit switch 244 thereby providing pressure on the trigger of the limit switch 244 to hold the switch 244 in an opened position.

Figure 9A:
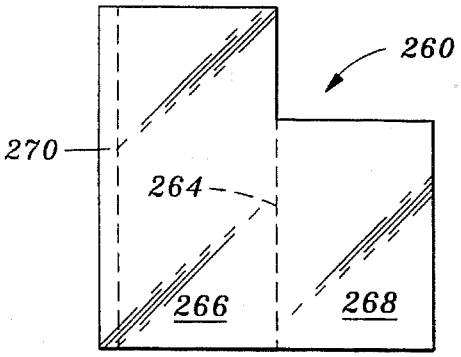
FIG. 9A is a front plane view of an envelope in an unfolded position.
Figure 9B:
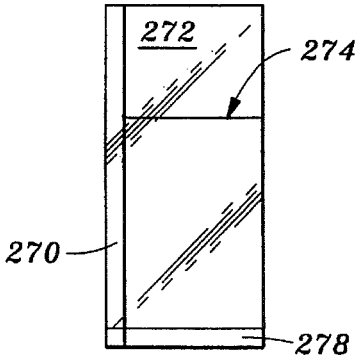
FIG. 9B is a front plane view of the envelope in a folded position.
Figure 9C:
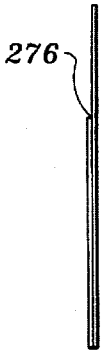
FIG. 9C is a side view of the envelope in a folded position.

Referring to FIGS. 9A through 9C, an envelope 260 for housing the pill is shown. The envelope 260 is formed from a planar blank 262 having a fold line 264 dividing two rectangular panels 266, 268. The first rectangular panel 266 is greater in height and width than the second panel 268. When folded along this fold line 264, the extra width of the first panel 266 is also folded over and onto the second panel 268 and secured thereto forming a lap seam 270. The extra height of the first panel 266 serves as a top flap 272 leading into a top opening 274 of a bore 276 that has a bottom fold 278 located at a lower edge of the folded panels 266, 268 thereby providing a pocket 280 and flap 272.

Figure 7:
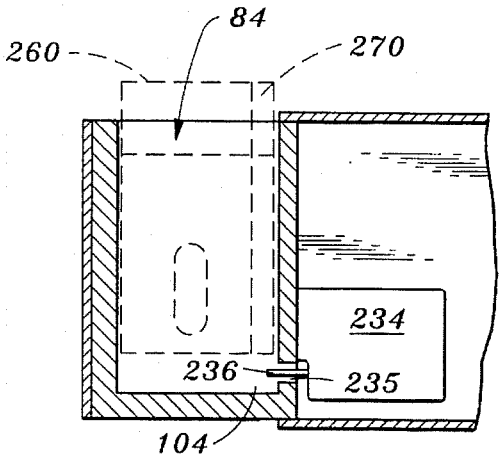
FIG. 7 is a sectional view of the present invention along lines 7—7 of FIG. 2.

FIG. 7 shows how the activation "fire" switch 234 is activated by the seam 270 of the envelope 260. The envelope 260 is placed in the shoulder 104 of the slot 84 and advanced to the bottom longitudinal side 94 of the housing 80. When in this position it pushes upon a lever 238 of the activation "fire" switch 234 extending through an aperture 235 in the back wall 86 of the housing 80.

Figure 7A:
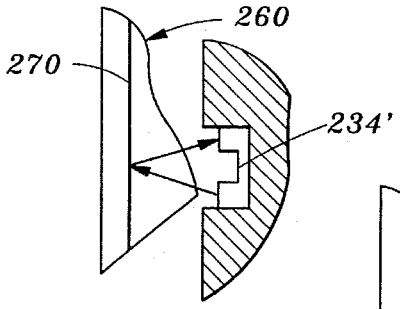
FIG. 7A is a perspective detail of an alternative embodiment of the switch shown in FIG. 7.
Figure 7B:
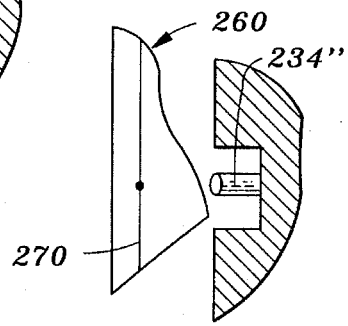
FIG. 7B is a perspective detail of a second alternative embodiment of the switch shown in FIG. 7.

Alternatively, an opto-coupler or opto-isolator, may take the place of the microswitch 234. The opto-coupler includes a light emitting diode (LED) emitter combined with a photodetector or phototransistor in close proximity, approximately one-eighth (⅛) of an inch. As shown in FIG. 7A, the opto-coupler has the LED and photodetector looking in the same direction so that it senses the presence of a reflective object nearby. The reflective object will be an aluminized surface along the lap seam 270. When the envelope 260 is placed in the shoulder 104 of the slot 84, the aluminized surface reflects the radiation emitted by the LED back to the photodetector thereby closing the "switch". When the envelope 260 is removed, the light is not reflected to the photodetector thereby acting as an open "switch".

The lap seam 270 of the envelope 260 may also contain a magnetic material in the form of a strip being adhered thereto or a spray that has been applied to the seam 210. The purpose of this magnetic strip is to trigger a hall effect switch which communicates through the aperture to the seam of the envelope.

Figure 10A:
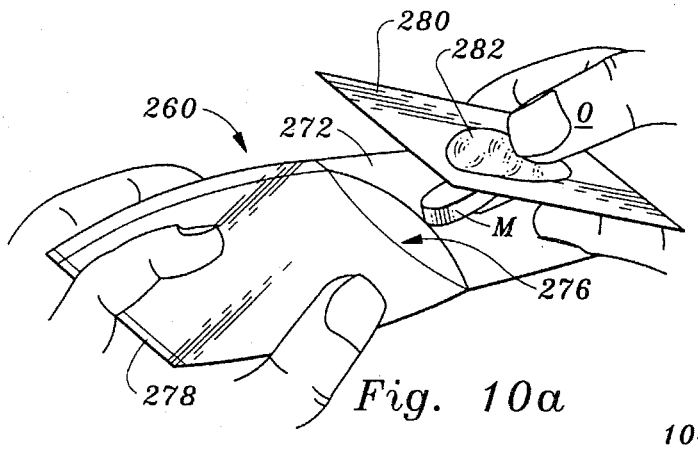
FIG. 10A is a perspective view of an operator holding the envelope and displacing a pill from a blister pack onto the top flap of the envelope.
Figure 10B:
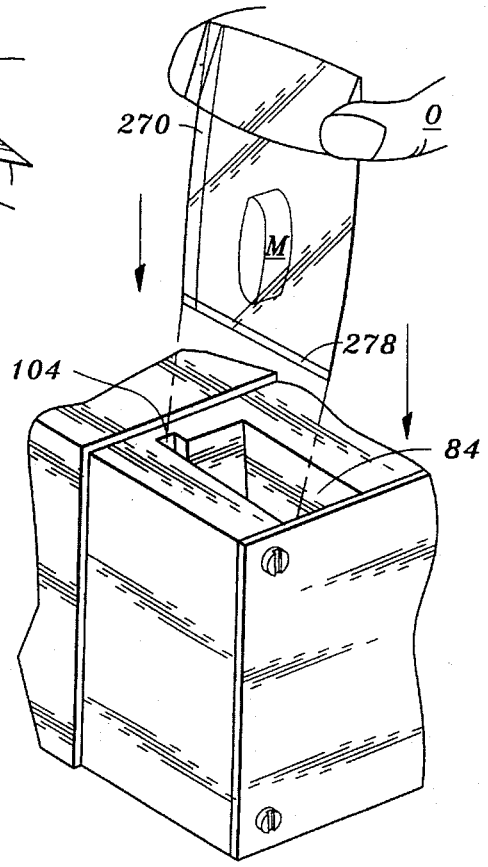
FIG. 10B is a perspective view of the operator placing the pill into the pill pulverizer with the top flap folded over.
Figure 10C:
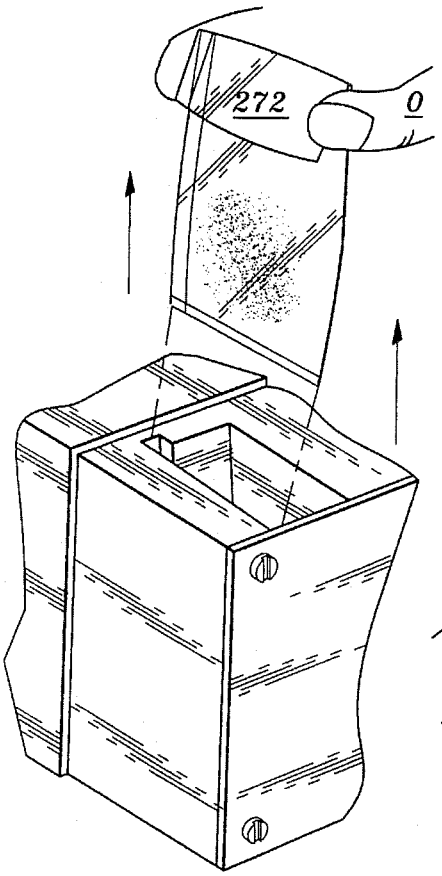
FIG. 10C is a perspective view of the operator removing the envelope from the pill pulverizer after subsequent pulverization.
Figure 10D:
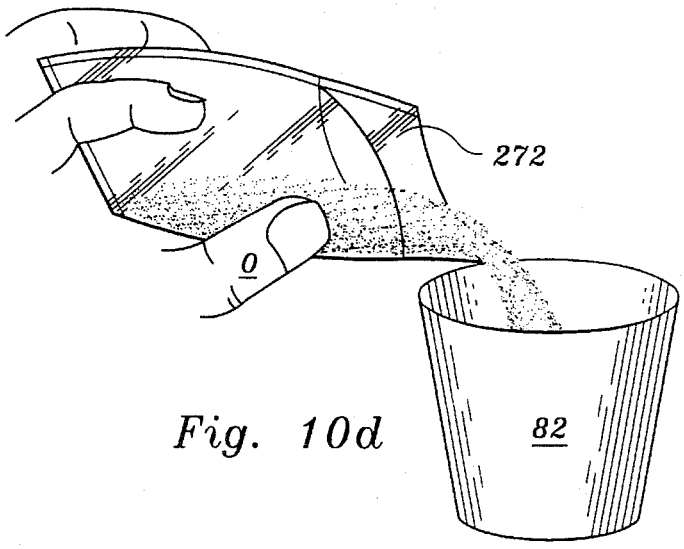
FIG. 10D is a perspective view of the operator pouring the powdered contents of the envelope into a cup once the top flap has been opened.

In use and operation, and referring to FIG. 10A, the operator O pushes the bubble 282 of a "blister pack" 280 with a thumb such that the medication M or nutrient is forced out the back side and onto the top flap 272 of the envelope 260. It is recommended that the administrator does not touch the pill.

Once the pill is on the top flap 272 of the envelope 260 the user can then incline the envelope 260 so that the pill slides toward the bottom seam 278 of the envelope 260. Folding the flap 272 over containerizes the medication or nutrient which is to be pulverized. The user inserts the side seam 270 of the envelope 260 into the shoulder 104 of the slot 84. This triggers the activation "fire" switch 234 which completes a first path for energy to flow to the drive motor 212 from the battery 224 and at the same time provides energy to a relay RE1 included in this first path. The relay RE1 in turn closes one of two switches, the latching switch 230, that lies in a second path for energy to flow to the drive motor 212 from the battery 224. The second switch, the limit switch 244, is in an open position until relieved by the cam-follower 166.

Once the activation "fire" switch 234 has been triggered it provides energy to the motor 212 which in turn transfers this energy, through a set of reduction gears 213, to a cam 190. Almost as soon as the cam 190 starts to rotate the toe 192 of the cam 190 is relieved from contact of the cam-follower 166 which has been provided with a notch 176 to allow the disengagement of the cam 190 and follower 166. This allows the potential energy stored in the compressed spring 180 to be released such that it slams the hammer 142 against the anvil 89 with the envelope 260 and its contents therebetween. This pulverizes the contents of the pill in one short blast.

In the meantime, limit switch 244 is closed and the cam 190 continues to rotate in a counter-clockwise direction. When the heel of the cam 190 comes into contact with the flat-faced cam-follower 166 it imparts energy to compress the spring 180. In other words, the rotational energy of the cam 190 moving across the face of the follower 166 is transferred into potential energy being stored in the spring 180.

When the spring 180 has been compressed a predetermined amount, an adjustable trip screw 174 hits a lever 248 which triggers the limit switch 244 to an open position. At this time, if the envelope 260 has been removed, the activation "fire" switch 234 is deactivated or in an open position and the hammer 142 is recocked and ready to fire. The limit switch 244 assures the disconnection of the battery 224 from the motor 212 when the cam 190 positions the impact means 140 in the cocked position even if the magnetic field of relay RE1 is sustained long enough to keep the latching switch 230 in the closed position. If the envelope 260 has not been removed, the activation "fire" switch 234 remains activated and the cam 190 continues to rotate in a counter-clockwise direction thereby disengaging from the cam-follower 166 which in turn releases pressure from the lever 246 that contacts the trip 248 of the limit switch 244 thereby closing the switch.

Since the activation "fire" switch 234 remains closed because the envelope 260 has not been removed, the latching switch 230 is also in a closed position thereby providing an energy path to the drive motor 212. Once the contents in the envelope 260 has been satisfactorily pulverized, it may be removed from the shoulder 104 of the slot 84. The top flap 272 is then opened and the contents of the envelope 260 may be poured into a cup 82 for dispensing.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A device for crushing pharmaceutical preparations to convert the preparations from a coherent mass to a powdered state comprising in combination:

energy storage means having an activated state and a quiescent state, means for retaining said energy storage means in said activated state, impact means operatively coupled to said energy storage means, and anvil means cooperating with said impact means, activation means to release said energy storage means from said activated state to said quiescent state whereby activation of said energy storage means causes said impact means to impart a blow to said anvil means, and means for returning said energy storage means from said quiescent state to said activated state after said activation means is deactivated.

2. The device of claim 1 including means to cock said impact means from a position where said energy storage means is in said quiescent state to a position where said energy storage means is in said activated state.

3. The device of claim 2 wherein said cocking means is disengaged from said impact means when said activation means is activated by a container encompassing the pharmaceutical preparation when said container is interposed between said anvil means and said impact means.

4. The device of claim 3 wherein said activation means includes a trigger adjacent said anvil and means to receive said container adjacent said anvil and affecting said activation means to begin motion of said impact means.

5. The device of claim 4 wherein said impact means includes a hammer constrained to reciprocate in an axially direction.

6. The device of claim 5 wherein said hammer is supported on a shaft, said shaft is operatively coupled to a follower and cam means operatively coupled to said follower to index said follower and therefore said hammer between a first retracted position and second deployed position.

7. The device of claim 6 wherein said cam is operatively coupled to a motor which is energized to retract said hammer from an anvil contacting position to a cocked at ready position, and spring means operatively coupled to said hammer, said motor storing energy in said spring means whereby upon release of said hammer said spring means dissipates energy toward said anvil.

8. A device to pulverize at least one pill, comprising in combination:

energy storage means, impact means operatively coupled to said energy storage means and moves from a first deployed position to a second retracted position, anvil means oriented to cooperate with said impact means, means interposed between said impact means and said anvil means to receive the pill, cocking means to retract said impact means from said deployed position to said retracted position, activation means for disengaging said cocking means from said impact means whereby said energy storage means accelerates said impact means from said retracted position to said deployed position imparting a blow to said anvil, means for returning said impact means from said deployed position to said retracted position after said activation means is deactivated.

9. The device of claim 8 wherein said activation means for disengaging said cocking means is activated by means for containing at least one pill in a sterile environment being placed into said receiving means.

10. The device of claim 9 wherein said cocking means includes a motor operatively coupled to a power source through said activation means and having an output shaft operatively coupled to a cam.

11. The device of claim 10 wherein said cam is detachably coupled to a cam-follower which is operatively coupled to said impact means.

12. The device of claim 11 wherein said cam disengages said cam-follower, when said activation means is activated, releasing said impact means from said retracted position to said deployed position whereby said energy storage means accelerates said impact means to impart a blow to said containing means that is received between said impact means and said anvil means.

13. The device of claim 12 wherein said cam is shaped such that it imparts a specified motion to said cam-follower, after said impact means is deployed, thereby reacting said impact means from said deployed position to said retracted position.

14. The device of claim 13 wherein said impact means includes a shaft having a first end and a second end, said first end of said shaft is operatively coupled to a hammer head, said shaft runs from said hammer head through an aperture in said cam-follower and on into a bore in a housing where said second end of said shaft is slideable coupled, said cam-follower is operatively coupled to said shaft and a spring circumscribes said shaft between said cam-follower and said bore in said housing.

15. The device of claim 14 wherein said cam-follower is substantially rectangular in shape and extends away from said shaft towards said cam, and is provided with a notch in a lower corner distal from said shaft.

16. A pill crusher comprising, in combination:

a removeable source of power, an impact means operatively coupled to said source of power to move between an impacting position and a cocked position, said source of power and said impact means located in a housing having a slot receiving means to admit a container therewithin, said slot receiving means including an anvil oriented to coact with said impact means, a trigger located in said slot receiving means and strategically located to be activated by said container, said trigger having means to release said impact means to approach said anvil and shock and crush a pill located in said container into loose powder when placed in said slot receiving means, whereby the pill is pulverized by both the force of the impacting means and its deceleration when contacting said container.

17. The pill crusher of claim 16 further including energy storage means operatively coupled to said impact means.

18. The pill crusher of claim 17 further including a motor operatively coupled to a power source through said trigger and having an output shaft operatively coupled to a cam.

19. The pill crusher of claim 18 wherein said cam is detachably coupled to a cam-follower which is operatively coupled to said impact means.

20. The pill crusher of claim 19 where said cam disengages said cam-follower, when said trigger is activated by said container, releasing said impact means from said cocked position to said impacting position whereby said energy storage means accelerates said impact means from said cocked position to said impacting position to shock and crush the pill located in said container.

21. The pill crusher of claim 20 further including means for returning said impact means from said impacting position to said cocked position after said trigger is deactivated.

22. The pill crusher of claim 21 wherein said impact means includes an impact shaft having a first end and a second end, said first end of said impact shaft is operatively coupled to a hammer head, said impact shaft runs from said hammer head on into a bore in said housing where said second end of said impact shaft is slideably coupled, said cam-follower is operatively coupled to said impact shaft and a spring circumscribes said shaft between said cam-follower and said bore in said housing.

23. The pill crusher of claim 22 wherein said cam-follower extends away from said impact shaft towards said cam, and is provided with a notch in a lower portion distal from said impact shaft.

* * * * *